US006206731B1

(12) United States Patent
Kuo

(10) Patent No.: US 6,206,731 B1
(45) Date of Patent: Mar. 27, 2001

(54) CABLE END CONNECTOR

(75) Inventor: Peter Kuo, Chung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/447,517

(22) Filed: Nov. 23, 1999

(30) Foreign Application Priority Data

Aug. 6, 1999 (TW) ..... 88213341

(51) Int. Cl.[7] ..... H01R 13/648

(52) U.S. Cl. ..... 439/610; 439/606; 439/553; 439/939

(58) Field of Search ..... 439/610, 606, 439/553, 92, 939

(56) References Cited

U.S. PATENT DOCUMENTS 5,709,569 * 1/1998 Buck et al. ..... 439/939
5,766,034 * 6/1998 Block et al. ..... 439/553
5,957,726 * 9/1999 Belopolsky et al. ..... 439/939
6,005,186 * 12/1999 Bachman ..... 439/939

* cited by examiner

*Primary Examiner*—Gary F. Paumen
(74) *Attorney, Agent, or Firm*—Wei Te Chung

(57) ABSTRACT

A cable end connector for being connected to a metallic enclosure panel comprises a connector body and a metallic shell. The shell is roughly rectangular in shape and is open at both a front end and a rear end. The shell forms a plurality of latches adjacent to its front edges and a bent outward tongue at each rear edge. The connector body comprises a roughly rectangular insulative housing defining a plurality of terminal-receiving passageways extending therethrough. A conductive metallic shielding plate covers the insulative housing except for the front face, and the shell then fits over the forward end of the housing. An insulative plastic cover covers the metallic shielding plate and the rearward half of the shell, embedding the outward bent tongues. The enclosure panel defines one or more holes therein and forms a plurality of tabs at peripheries of the holes, each tab defining an aperture corresponding to a latch on the front edge of the shell. In use, the front end of the cable end connector is inserted front end first between the tabs of the enclosure panel, the latches of the shell engaging with the apertures on the enclosure panel.

1 Claim, 6 Drawing Sheets

CABLE END CONNECTOR

BACKGROUND OF THE INVENTION

1. Field of the Invention

The present invention relates to an electrical end connector and particularly to an EMI shielded cable end connector for being connected to an enclosure panel without using a screw, and which can be quickly attached to a panel of a computer enclosure.

2. Description of the Prior Art

A cable end connector is generally used with a cable which is to be attached to a rear panel of a computer enclosure for providing an input/output port. One such connector is disclosed in Taiwan Patent Application No.86102688. As shown in FIGS. 5 and 6, a conventional cable connector 5 mainly comprises a plastic housing 50 which includes a pair of screws 51 on opposite sides thereof, and a metallic shell 52 at a forward end thereof. An enclosure panel 6 defines an engaging aperture 60 and a pair of holes 61 at either side of the aperture 60. The shell 52 of the cable end connector 5 is received in the engaging aperture 60 of the enclosure panel 6 and the screws 51 are threaded into the holes 61 to retain the cable connector 5 thereon. The connection of the shell 52 with the engaging aperture 60 shields the cable connector 5 and the enclosure panel 6 from EMI. This method of EMI shielding requires a high precision assembly. Inaccurate assembly may result in a space d being formed between the shell 52 and the enclosure panel 6 (see FIG. 6) and consequently poor EMI shielding. Therefore, a cable connector providing reliable and effective EMI shielding is desired.

SUMMARY OF THE INVENTION

The main object of the present invention is to provide an EMI shielded cable end connector having a metallic shell for grounding to an enclosure panel which reliably and snugly attaches the cable connector to the enclosure panel leaving no gap therebetween and providing effective EMI shielding.

A cable connector in accordance with the present invention comprises a connector body and a metallic shell assembled to the connector body. The shell can be snugly assembled against openings of an enclosure panel.

The shell is a roughly rectangular in shape, the front and rear ends being open. Each of the top and bottom walls of the shell defines a pair of wide latches adjacent to the front edge thereof, and each of the side walls defines a narrow latch adjacent to the front edge thereof. A tongue extends outwardly from a rear edge of each of the top, bottom, and two side walls.

The connector body includes an insulative housing, a conductive shielding plate covering the housing except for a front face of the housing, an insulative plastic cover partially overlaying the shielding plate, and a cable nipple formed at the rear end of the cover. The shell is fitted over the front portion of the housing covered by the shielding plate so that the front edges of the shell are flush with the front face of the housing. The plastic cover over molds the rear half of the shell, embedding the tongues of the shell therein and allowing space for the wide and narrow latches to engage with corresponding apertures in the enclosure panel (described hereinafter).

The enclosure panel defines two openings side-by-side, a wide tab being formed at each of the upper and lower edges of each opening and a narrow tab being formed at the outermost lateral edge of each opening. Each wide tab defines a wide aperture therein to engage with a wide latch of the shell and each narrow tab defines a narrow aperture therein to engage with a narrow latch of the shell.

Other objects, advantages and novel features of the invention will become more apparent from the following detailed description when taken in conjunction with the accompanying drawings.

DETAILED DESCRIPTION OF THE INVENTION

Figure 1:
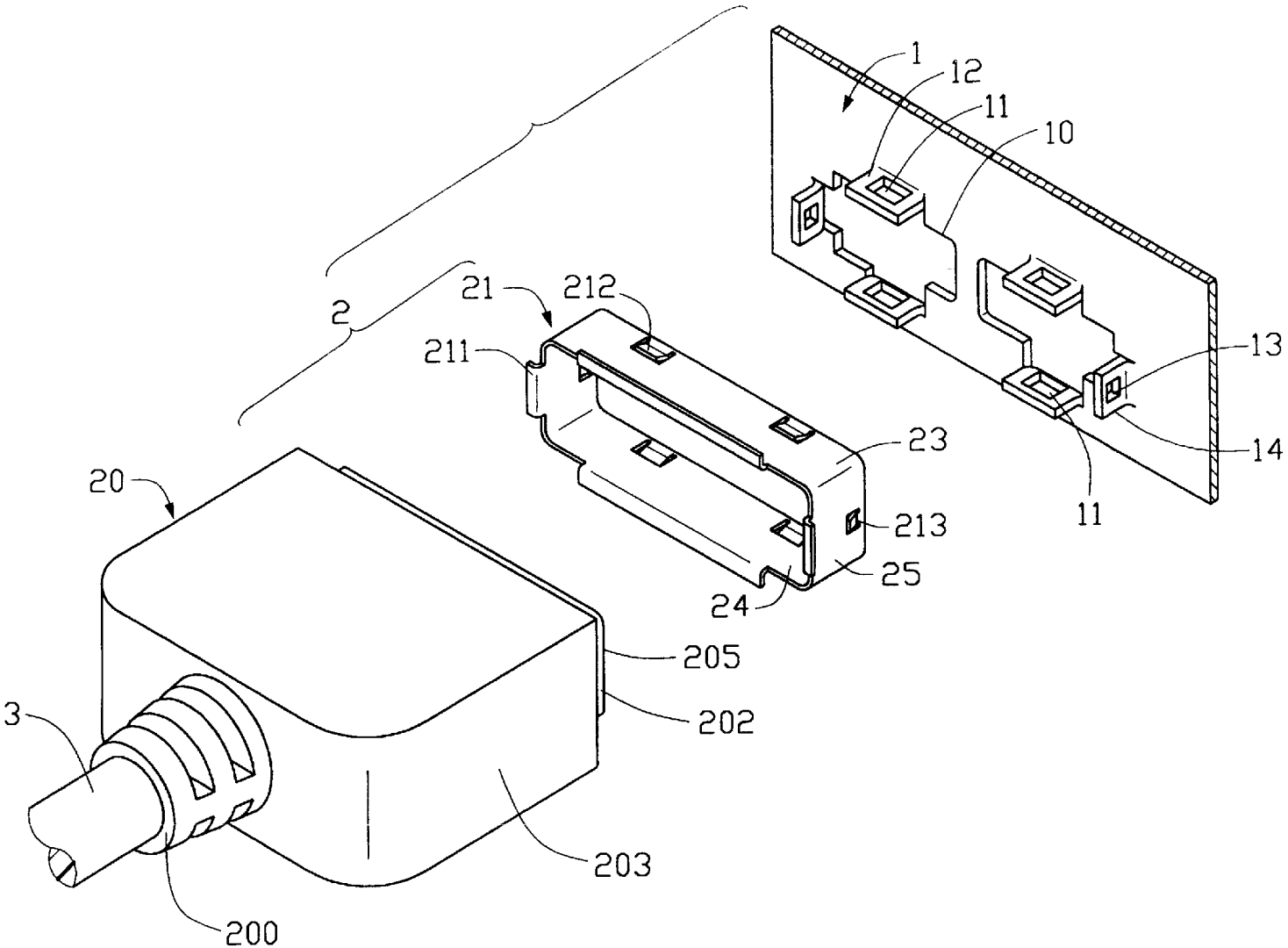
FIG. 1 is a partially assembled perspective view of a cable connector and an enclosure panel of the present invention.
Figure 2:
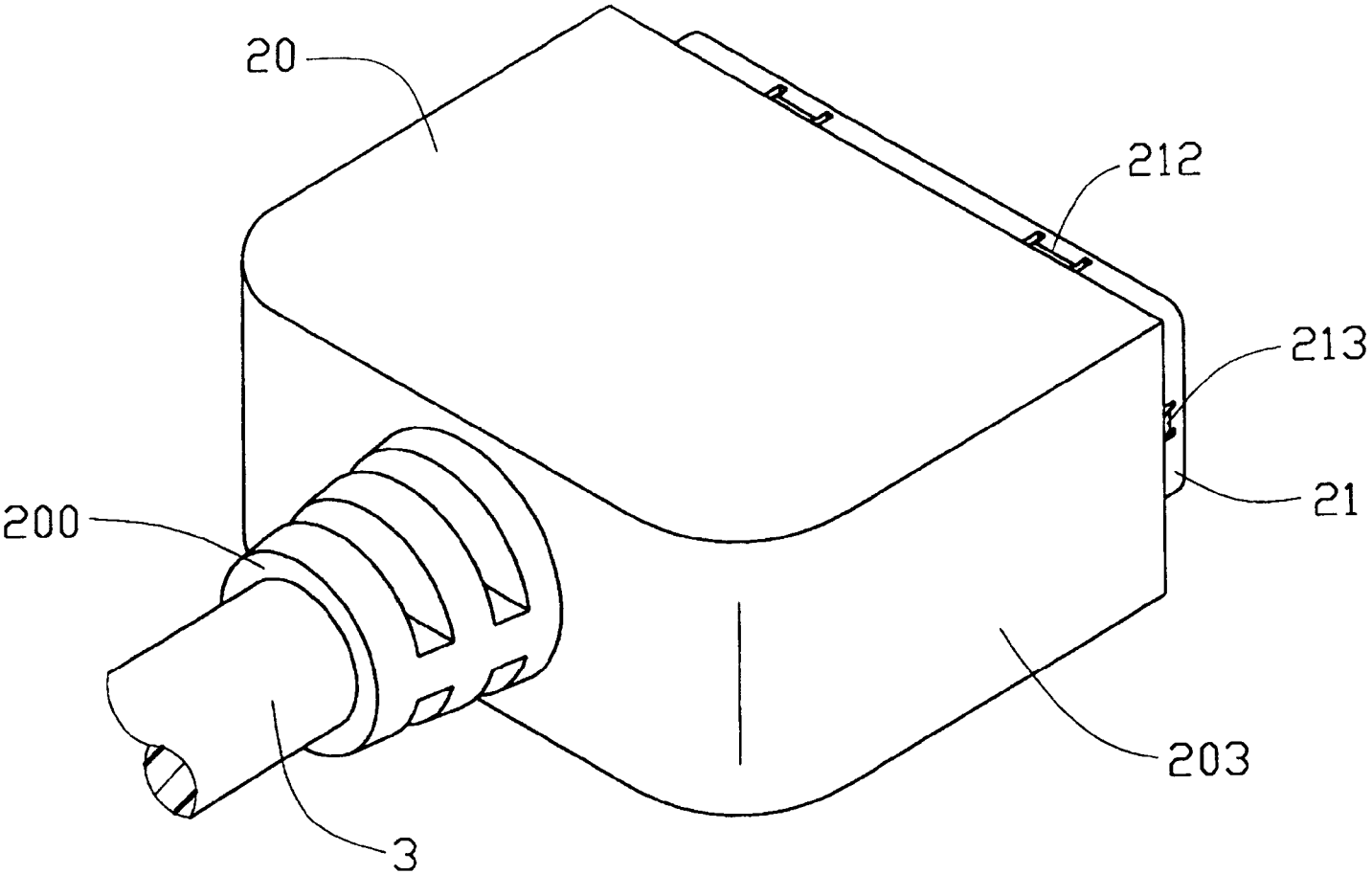
FIG. 2 is an assembled view of the cable connector in FIG. 1.
Figure 3:
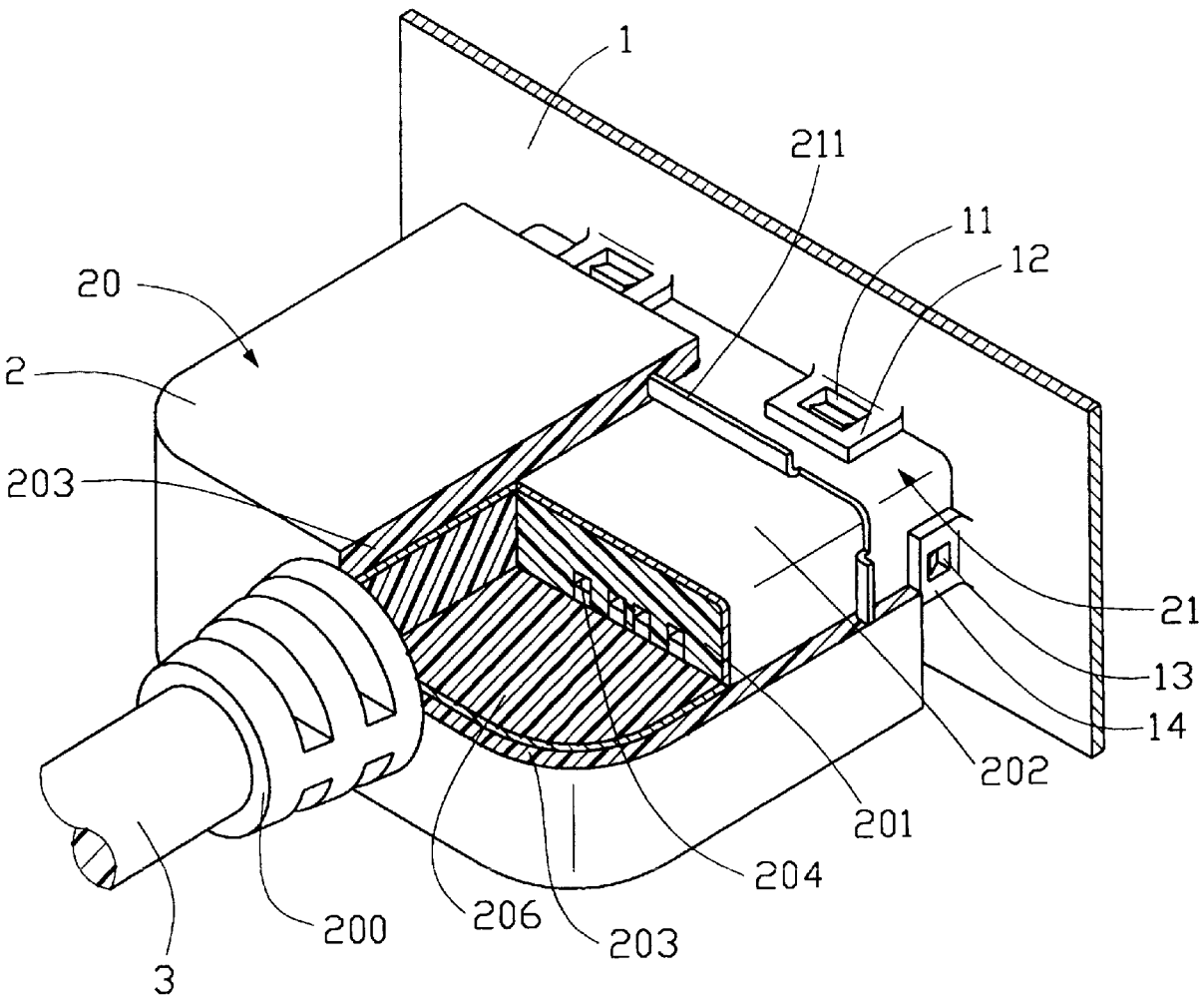
FIG. 3 is a partially cutaway assembled view of FIG. 1.
Figure 4:
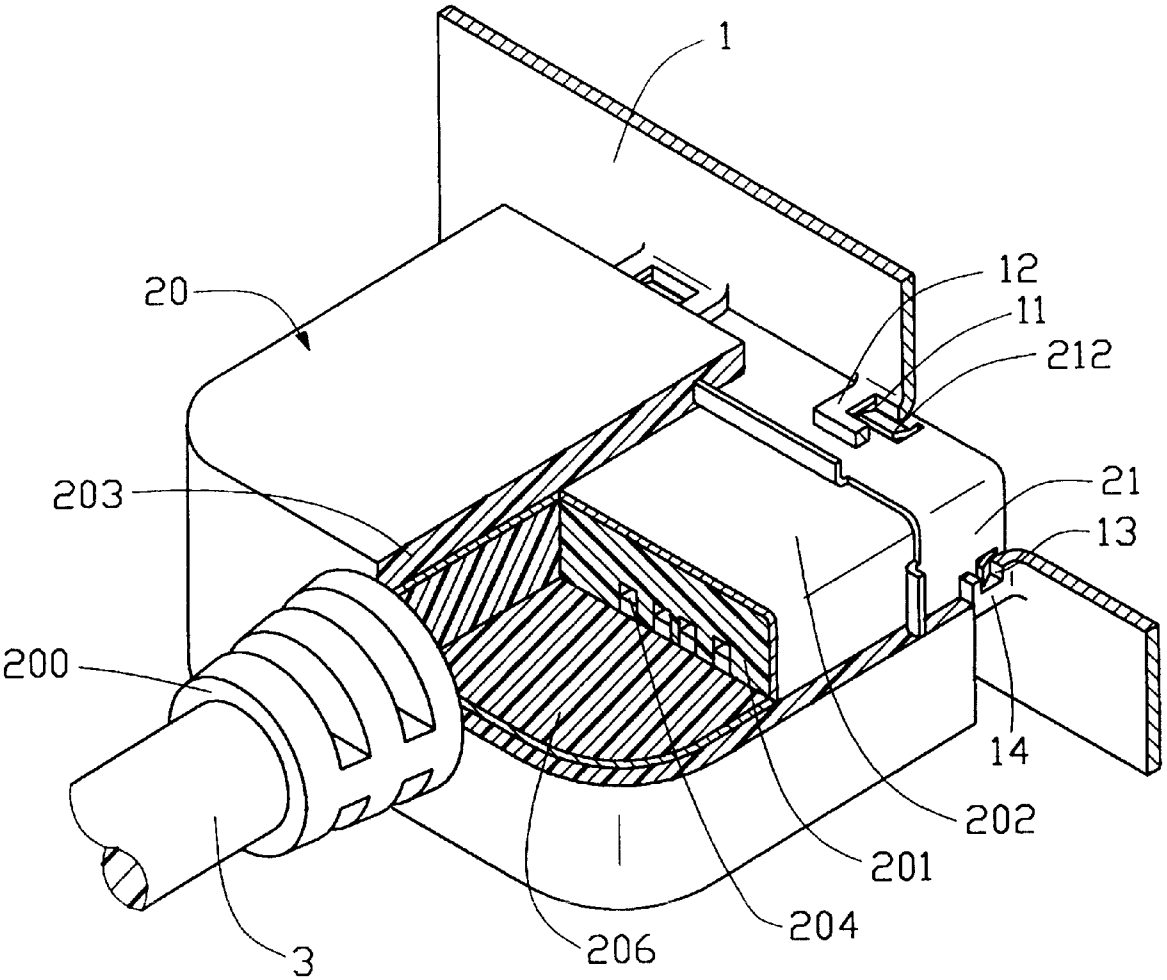
FIG. 4 is a view of FIG. 3 with the enclosure panel partially cut away.
Figure 5:
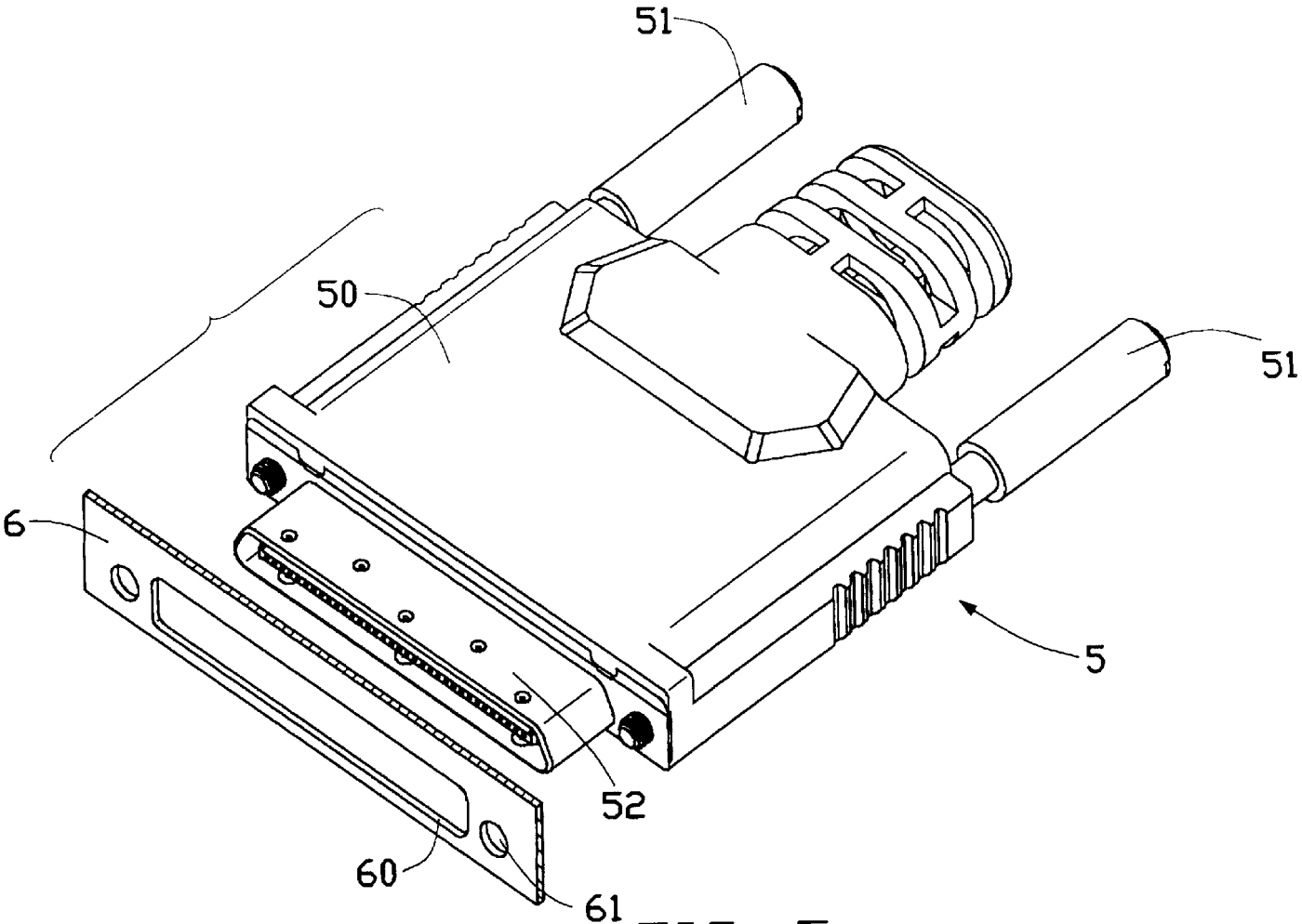
FIG. 5 (PRIOR ART)
FIG. 5 is an unassembled perspective view of a conventional cable connector and an enclosure panel.
Figure 6:
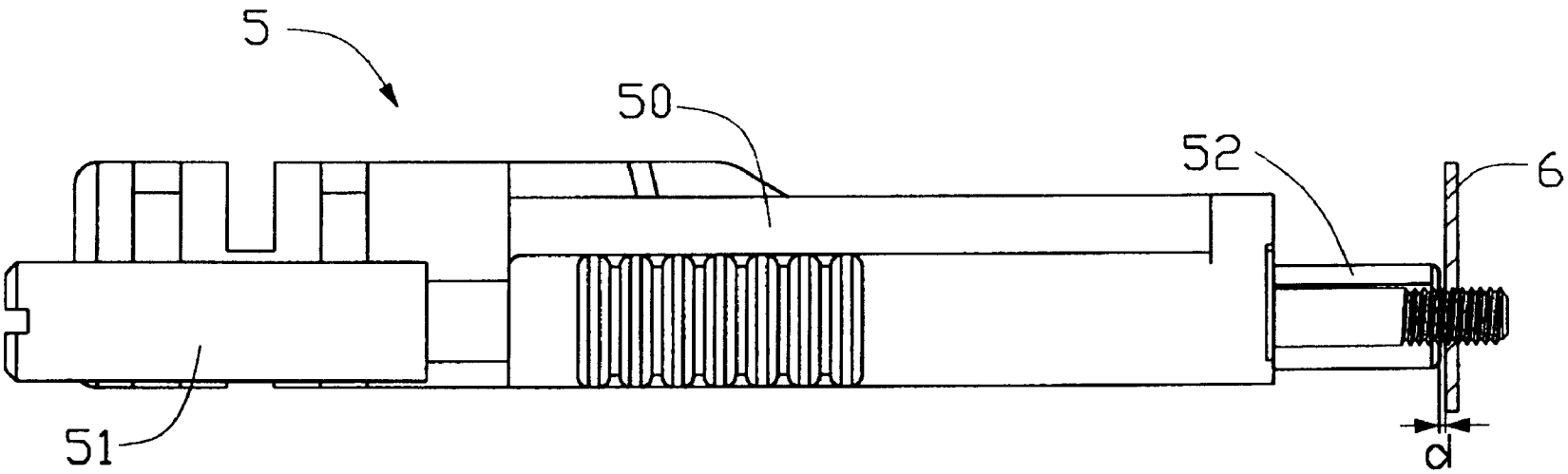
FIG. 6 (PRIOR ART)
FIG. 6 is an assembled side view of FIG. 5.

Referring to FIGS. 1 to 4, a cable end connector 2 in accordance with the present invention comprises a connector body 20 and a metallic shell 21. The cable end connector 2 is configured to mate with a pair of openings 10 in an enclosure panel 1.

The metallic shell 21 is roughly rectangular in shape and includes an elongated top wall 23, an elongated bottom wall 24 and two shorter side walls 25. Two wide latches 212 are defined in each of the top and bottom walls 23, 24 adjacent to front edges thereof, and one narrow latch 213 is defined in each side wall 25 adjacent to front edges thereof. A tongue 211 extends from a rear edge of each of the four walls, each tongue 211 bending outwardly to a perpendicular position therefrom. The shell 21 is open at both a front end and a rear end.

The connector body 20 includes an insulative housing 201 roughly rectangular in shape having an elongated front face 205 (FIG. 1) and a slightly rounded rear face 206 opposite the front face 205. A plurality of passageways 204 is defined therein in communication with the front face 205 and the rear face 206 for receiving a plurality of terminals (not labeled) therein. A conductive shielding plate 202 covers the housing 201 except for the front face 205. The conductive shell 21 is fitted over the front portion of the housing 201 covered by the shielding plate 202 so that the front edges of the shell 21 are flush with the front face 205 of the housing 201. An insulative plastic cover 203 overlays the shielding plate 202 and a rear half of the shell 21, allowing space for wide latches 212 and narrow latches 213 on the shell 21 to engage with corresponding apertures (described below). The tongues 211 of the shell 21 are embedded in the insulative plastic cover 203 assuring secure retention of the shell 21 in the cable connector 2. Appropriate openings at the rear of the housing 201, the shielding plate 202 and the plastic cover 203 allow connection between the terminals of the housing and wires of a cable 3. The insulative plastic cable nipple 200 is integrally formed with a rear side of the plastic cover 203 and provides the mechanical connection between the cable connector 2 and a cable 3.

The conductive metallic enclosure panel 1 defines the pair of elongated openings 10 therein, a wide tab 12 extending outward from an upper edge and a lower edge of each opening 10, and a narrow tab 14 extending outward from an outermost lateral edge of each opening 10. A wide aperture 11 is defined in each wide tab 12 to correspond to a wide latch 212 of the shell 21. A narrow aperture 13 is defined in each narrow tab 14 to correspond to a narrow latch 213 of the shell 21. In use, the front end of the assembled cable end connector 2 is connected to the enclosure panel 1 wherein the shell 21 of the cable connector 2 fits between the tabs 12, 14 of the panel 1 for confining lateral movement of the connector 2 with regard to the panel 1, the wide and narrow latches 212, 213 engage with the wide and narrow apertures 11, 13, respectively, for preventing backward movement of the connector 2 with regard to the panel 1 in a front-to-back direction, and the front edge of the shell 21 engages the back surface of the panel 1 for preventing forward movement of the connector 2 with regard to the panel 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector connected to an enclosure panel, comprising:

a connector body having an insulative housing, a metal shielding plate covering substantially the entire housing except for a front face of the housing, a plastic cover partially enclosing the shielding plate, and a cable nipple at a rear end thereof; and a frame-like metal shell connecting the connector body to the enclosure panel, a front portion of the shell being aligned with at least one mating aperture defined in the enclosure panel, a rear portion of the shell being telescopingly in contact with a front section of the shielding plate and being overmolded by the plastic cover;

wherein the shell includes an elongated top wall, an elongated bottom wall and two side walls and is open at both a front end and a rear end thereof;

wherein the front portion of the shell defines two first latches at each of the top and the bottom walls and a second latch at each side wall;

wherein the rear portion of the shell defines a tongue bending outwardly from an edge of each wall of the shell;

wherein the plastic cover overlies the shielding plate and the tongues of the shell are embedded in the plastic cover while leaving a space for the latches of the shell to resiliently engage with the at least one aperture of the enclosure panel.

* * * * *